US007519306B2

(12) United States Patent
Inoue et al.

(10) Patent No.: US 7,519,306 B2
(45) Date of Patent: Apr. 14, 2009

(54) FIXING APPARATUS AND IMAGE FORMING APPARATUS INCLUDING PRIORITY TEMPERATURE CONTROL

(75) Inventors: Noriko Inoue, Yamatokoriyama (JP); Atsushi Ide, Nara (JP); Kohji Aoki, Nara (JP); Yasuhiro Takai, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 134 days.

(21) Appl. No.: 11/679,219

(22) Filed: Feb. 27, 2007

(65) Prior Publication Data

US 2007/0217805 A1 Sep. 20, 2007

(30) Foreign Application Priority Data

Mar. 14, 2006 (JP) ..... 2006-069979

(51) Int. Cl.
*G03G 15/20* (2006.01)

(52) U.S. Cl. ..... 399/69; 399/334

(58) Field of Classification Search ..... 399/69, 399/67, 33, 320, 334, 45; 219/216, 255
See application file for complete search history.

(56) References Cited

U.S. PATENT DOCUMENTS 7,184,697 B2 * 2/2007 Kinouchi et al. ..... 219/216 X
2004/0208665 A1 * 10/2004 Takematsu ..... 399/69
2005/0191074 A1 * 9/2005 Matsumoto ..... 399/69
2005/0207773 A1 * 9/2005 Nakayama ..... 399/69
2005/0286919 A1 * 12/2005 Matsumoto ..... 399/69
2007/0036572 A1 * 2/2007 Ide et al. ..... 399/69
2007/0217804 A1 * 9/2007 Mikita et al. ..... 399/69

FOREIGN PATENT DOCUMENTS

JP 08-095420 4/1996
JP 2004-013058 1/2004

* cited by examiner

*Primary Examiner*—Sophia S Chen
(74) *Attorney, Agent, or Firm*—Renner, Otto, Boisselle & Sklar, LLP

(57) ABSTRACT

A fixing control section of a fixing apparatus according to the present invention includes an end section priority temperature control mode. In the end section priority temperature control mode, the fixing control section temporarily turns off a main heater heating a center section of a fixing roller among a plurarity of heaters disposed inside the fixing roller in a case where a surface temperature of the end section of the fixing roller has reached a preset upper-limit fixing temperature, even if the surface temperature of the center section of the fixing roller is lower than a preset fixing temperature. As a result, destruction of the fixing roller can be prevented by a simple arrangement in the fixing apparatus which includes a plurarity of the heaters disposed inside the fixing roller.

6 Claims, 7 Drawing Sheets

CROSS SECTION
OF END SECTION

CROSS SECTION
OF CENTER SECTION

FIXING APPARATUS AND IMAGE FORMING APPARATUS INCLUDING PRIORITY TEMPERATURE CONTROL

This Nonprovisional application claims priority under 35 U.S.C. § 119(a) on Patent Application No. 069979/2006 filed in Japan on Mar. 14, 2006, the entire contents of which are hereby incorporated by reference.

FIELD OF THE INVENTION

The present invention relates to (i) a fixing apparatus incorporated into an image forming apparatus using an electarophotographic process, for example, a copying machine, a facsimile, a printer, and a multifunction machine, and (ii) an image forming apparatus using the same.

BACKGROUND OF THE INVENTION

Conventionally, a heat roller fixing method has been generally used in a fixing apparatus incorporated into an image forming apparatus using an electrophotographic process. A copying machine and a printer are examples of such image forming apparatus. In the heat roller fixing method, two fixing rollers, at least one of which is heated, are press-contacted to each other. A paper sheet (recording material) holding an unfixed toner image thereon passes between the two fixing rollers so that the toner image is fused and fixed on the paper sheet.

A method that has been adopted in recent years is a method in which a plurality of heaters (heat sources, heat members) are disposed inside the fixing roller to partially heat the fixing rollers. This method is adopted for the purposes of (i) reducing energy consumption of the image forming apparatus and (ii) improving life characteristics of the fixing rollers in the fixing apparatus.

One example of an arrangement in which a plurality of heaters are disposed is an arrangement in which two heaters, a main heater and a sub-heater, are disposed. The main heater heats a center section of a fixing roller, and the sub-heater heats both end sections of the fixing roller. The main heater heats a region of the fixing roller where a small-sized paper sheet passes among paper sheets processable in an image forming apparatus. The sub-heater heats end sections of the fixing roller through which a large-sized paper sheet passes.

In a surface temperature control of a fixing roller, the fixing roller is controlled so that a surface of the fixing roller keeps a preset fixing temperature. Generally, when a detected surface temperature of the fixing roller exceeds the preset fixing temperature, the heater is turned off. On the other hand, when the detected surface temperature is below the preset fixing temperature, the heater is turned on. In an arrangement in which a plurality of heaters are disposed, temperature sensors for detecting surface temperatures of the fixing roller are provided respectively in heating regions of the respective heaters. On the basis of the temperatures detected by the temperature sensors, power to the heaters corresponding to the respective temperature sensors are on/off controlled.

Moreover, conventionally, there have been suggested methods for preventing the occurrence of overshoot that is a phenomenon in which the surface temperature of a fixing roller temporarily takes a sudden rise right after the fixing roller is stopped. For example, Japanese Unexamined Patent Publication No. 95420/1996 (Tokukaihei 8-95420 (published on Apr. 12, 1996)) discloses an arrangement in which a heater stops heating a fixing roller at the same time as the fixing roller stops rotating, and the temperature starts to be controlled again after the surface temperature of the fixing roller starts to decrease.

However, in the arrangement in which a plurality of heaters are disposed inside the fixing roller, the surface temperature may exceed a destructive temperature at the end sections of the fixing roller. In such a case, the surface layer of the fixing roller may be deteriorated or damaged due to heat.

In the case of heaters whose heat generating regions that give off heat are different from each other, including the main heater and the sub-heater, positions that are in no need of heating in a fixing roller are unnecessarily heated.

FIG. 7 illustrates a relationship between a position of the fixing roller in its axial direction and a heat supply rate in the main heater and the sub-heater. On the assumption that heat supplied by the main heater is 100% at the center section of the fixing roller where the main heater needs to heat, substantially 25% of heat is supplied to the end sections of the fixing roller where the main heater does not need to heat. Similarly on the assumption that heat supplied by the sub heater is 100% at the end sections of the fixing roller where the sub-heater needs to heat, substantially 20% of heat is supplied to the center section of the fixing roller where the sub-heater does not need to heat.

Due to such an unnecessary heat supply to the fixing roller, the surface layer of the fixing roller may be destroyed when continuous printing is carried out on small-sized paper sheets.

FIG. 8(*a*) illustrates a relationship between a position of the fixing roller in its axial direction and a surface temperature of the fixing roller right after or during the continuous printing using small-sized paper sheets. As illustrated in FIG. 8, the surface temperature of the fixing roller decreases because heat of the fixing roller is taken away by the paper sheet passing between the fixing rollers. Thus, the surface temperature of the center section of the fixing roller becomes lower than the preset fixing temperature of the center section. The decrease in temperature at the center section of the fixing roller is detected by a center section temperature sensor for detecting a temperature at the center section of the fixing roller. As a result, the main heater is turned on.

On the other hand, decrease in surface temperature does not occur at the end sections of the fixing roller where the paper sheet does not pass through. Accordingly, the sub-heater is kept off in accordance with a temperature detected by an end section temperature sensor for detecting a temperature at the end section of the fixing roller. In theory, the end sections of the fixing roller are kept at the preset fixing temperature until the temperatures at the end sections of the fixing roller decrease due to heat dissipation.

However, in practice, as illustrated in FIG. 8(*a*), the surface temperatures at the end sections severely exceed the preset fixing temperature. This is due to unnecessary heat supply from the aforesaid main heater. Specifically, because the paper sheets continuously pass the center section, the main heater is kept on, during which the main heater supplies unnecessary heat to the end sections of the fixing roller. Accordingly, the surface temperature of the fixing roller gradually rises at the end sections although the sub-heater is turned off.

The range of temperatures that exceed the preset fixing temperature increases with increase in printed paper sheet count. If the printed paper sheet count increases further, the surface temperature of the fixing roller exceeds a destructive temperature at the end sections of the fixing roller, as illustrated in FIG. 8(*b*). This destroys the surface layer of the fixing roller.

The destruction of the surface layer of the fixing roller can be prevented before it happens, with an arrangement in which: (i) a destruction prevention temperature is set at a temperature a little lower than the destructive temperature and (ii) the operation of the image forming apparatus is stopped emergently at a point in time when the end section temperature sensor detects that surface temperature of the end section of the fixing roller has reached a destruction prevention temperature that is preset to be a little lower than the destructive temperature. However, such an arrangement leads to decrease in operation rate of the image forming apparatus.

The aforesaid Japanese Unexamined Patent Publication does not consider the arrangement in which a plurality of heaters are disposed inside the fixing roller. Accordingly, the aforesaid Japanese Unexamined Patent Publication cannot solve the problem mentioned above.

SUMMARY OF THE INVENTION

The present invention is attained in view of the problems mentioned above. An object of the present invention is to provide a fixing apparatus, which can prevent the fixing roller from being destroyed due to unnecessary heat supply from heaters that can be heated partially in a simple arrangement, and an image forming apparatus using the same. The fixing apparatus is disposed with plural heaters and can be partially heated.

In order to solve the problem mentioned above, according to the present invention, a fixing apparatus which causes a recording material to pass through a space between a rotatable fixing member and a pressure member that press-contacts the fixing member, so as to fix a toner image formed on the recording material, includes: a heating section, provided inside the fixing member, which includes a plurality of heat sources having mutually different heating regions; a temperature detecting section which detects surface temperatures of areas on the fixing member corresponding to the heating regions of the respective heat sources; and a fixing control section which controls (i) rotation of the fixing member and (ii) power supply to each of the heat sources so that the surface temperatures of the fixing member become a preset fixing temperature, in accordance with temperatures detected by the temperature detecting section, wherein: the fixing control section (i) controls power supply to a center section heat source which heats as the heating region a center section of the fixing member, in accordance with (a) a detected surface temperature of an area on the fixing member corresponding to the heating region of the center section heat source and (b) a detected surface temperature of an area on the fixing member corresponding to the heating region of an end section heat source which heats end sections of the fixing member, the heating region of the end section heat source being provided on an end section side of the fixing member with respect to the center section heat source, and (ii) includes an end section priority temperature control mode in which a high priority in the control of power supply to the center section heat source is put on the detected surface temperature of the area corresponding to the heating region of the end section heat source.

In order to solve the problem mentioned above, according to the present invention, an image forming apparatus including a fixing apparatus which causes a recording material to pass through a space between a rotatable fixing member and a pressure member that press-contacts the fixing member, so as to fix a toner image formed on the recording material, the image forming apparatus includes: a heating section, provided inside the fixing member, which includes a plurality of heat sources having mutually different heating regions; a temperature detecting section which detects surface temperatures of areas on the fixing member corresponding to the heating regions of the respective heat sources; and a fixing control section which controls (i) rotation of the fixing member and (ii) power supply to each of the heat sources so that the surface temperatures of the fixing member become a preset fixing temperature, in accordance with temperatures detected by the temperature detecting section, wherein: the fixing control section (i) controls power supply to a center section heat source which heats as the heating region a center section of the fixing member, in accordance with (a) a detected surface temperature of an area on the fixing member corresponding to the heating region of the center section heat source and (b) a detected surface temperature of an area on the fixing member corresponding to the heating region of an end section heat source which heats end sections of the fixing member, the heating region of the end section heat source being provided on an end section side of the fixing member with respect to the center section heat source, and (ii) includes an end section priority temperature control mode in which a high priority in the control of power supply to the center section heat source is put on the detected surface temperature of the area corresponding to the heating region of the end section heat source.

According to the above-mentioned arrangement, the fixing control section includes the end section priority temperature control mode. In the end section priority temperature control mode, the fixing control section (i) controls power supply to a center section heat source which heats as the heating region a center section of the fixing member, in accordance with (a) a detected surface temperature of an area on the fixing member corresponding to the heating region of the center section heat source and (b) a detected surface temperature of an area on the fixing member corresponding to the heating region of an end section heat source which heats end sections of the fixing member, the heating region of the end section heat source being provided on an end section side of the fixing member with respect to the center section heat source, and (ii) puts a high priority in the control of power supply to the center section heat source on the detected surface temperature of the area corresponding to the heating region of the end section heat source.

For example, as a result of continuous power supply to the center section heat source for continuous printing on small-sized paper sheets, the surface temperature of the end section of the fixing member gradually rises due to unnecessary heat supply to the end section of the fixing member from the center section heat source although the power supply to the end section heat source is stopped. In such a case, if the surface temperature of the end section of the fixing member reaches an abnormally high temperature, the fixing control section controls the power supply to the center section heat source.

Accordingly, it is possible to prevent the occurrence of an event where the surface layer of the fixing member is destroyed due to a rise in the temperature at the end section of the fixing member by the unnecessary heat supply.

The end section priority temperature control mode can be carried out (i) during printing or (ii) during a temperature restoration process of the fixing member right after end of printing.

For a fuller understanding of the nature and advantages of the invention, reference should be made to the ensuing detailed description taken in conjunction with the accompanying drawings.

DESCRIPTION OF THE EMBODIMENTS

An image forming apparatus according to an embodiment of the present invention is explained below with reference to FIGS. 1 through 6.

Figure 2:
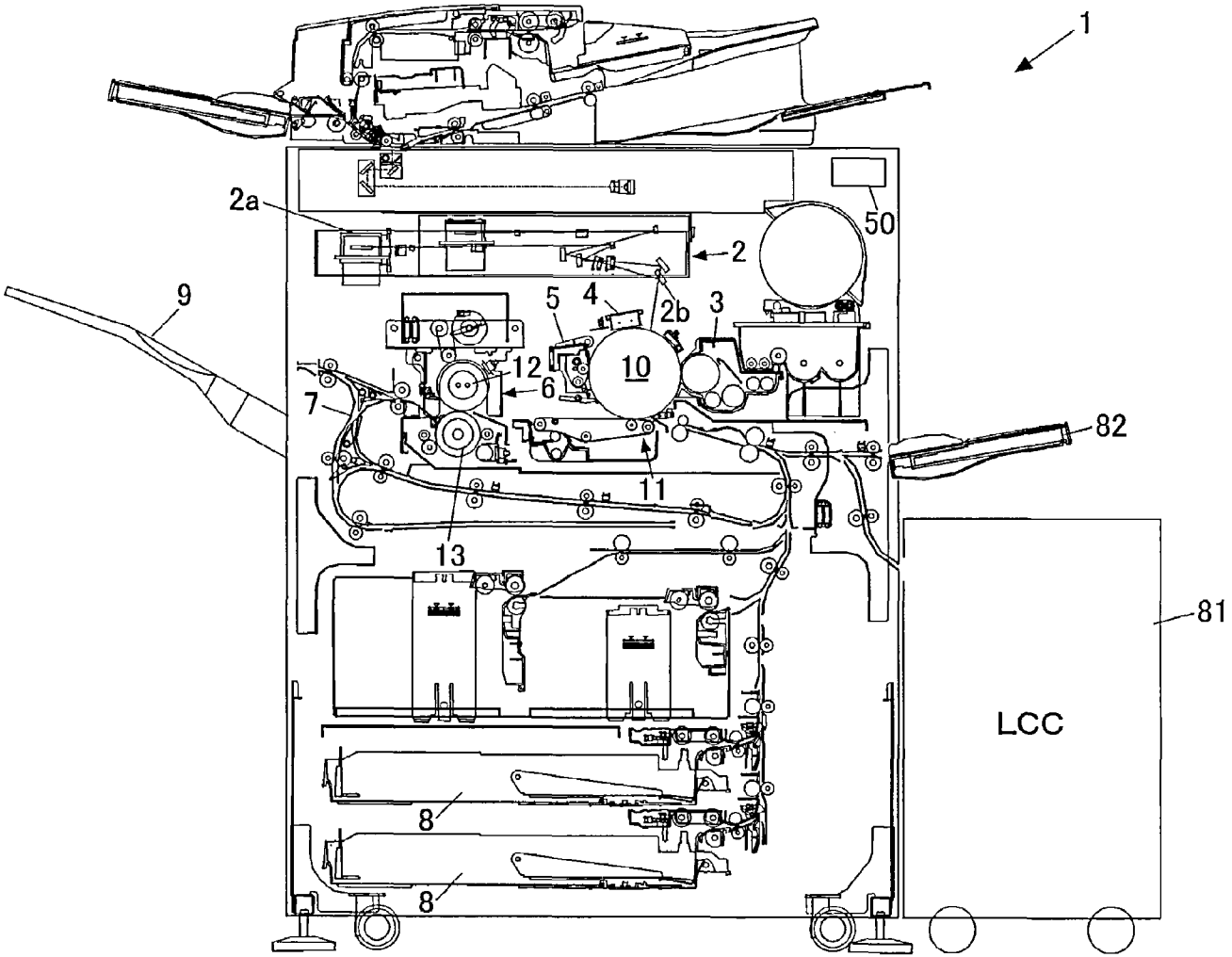
FIG. 2 is a longitudinal sectional view illustrating an embodiment of the present invention and a structure of an image forming apparatus including the fixing unit.

FIG. 2 is a longitudinal sectional view of an image forming apparatus 1 of the present embodiment. The image forming apparatus 1 of the present embodiment forms a single color image with respect to a predetermined sheet (recording sheet) in accordance with image data transmitted externally and/or image data read by the image forming apparatus 1 itself. The image forming apparatus 1, as illustrated in FIG. 2, includes an exposure unit 2, a developing unit 3, a photoreceptor drum 10, a transfer unit 11, an electrostatic charging unit 4, a cleaning unit 5, a fixing unit (fixing apparatus) 6, a paper feed tray 8, a output paper tray 9, and a control section 50.

The electrostatic charging unit 4 is a section for electrostatically charging a surface of the photoreceptor drum 10 to a predetermined potential evenly. The electrical charging unit 4 may be a noncontact discharger as illustrated in FIG. 2. Alternatively, the electrical charging unit 4 may be a contact electrostatic charger of roller type or brush type.

The exposure unit 2 subjects the photoreceptor drum 10 that has been evenly charged by the electrostatic charging unit 4 to exposure according to the image data, so as to form a latent image corresponding to the image data on the surface of the photoreceptor drum 10.

Figure 1:
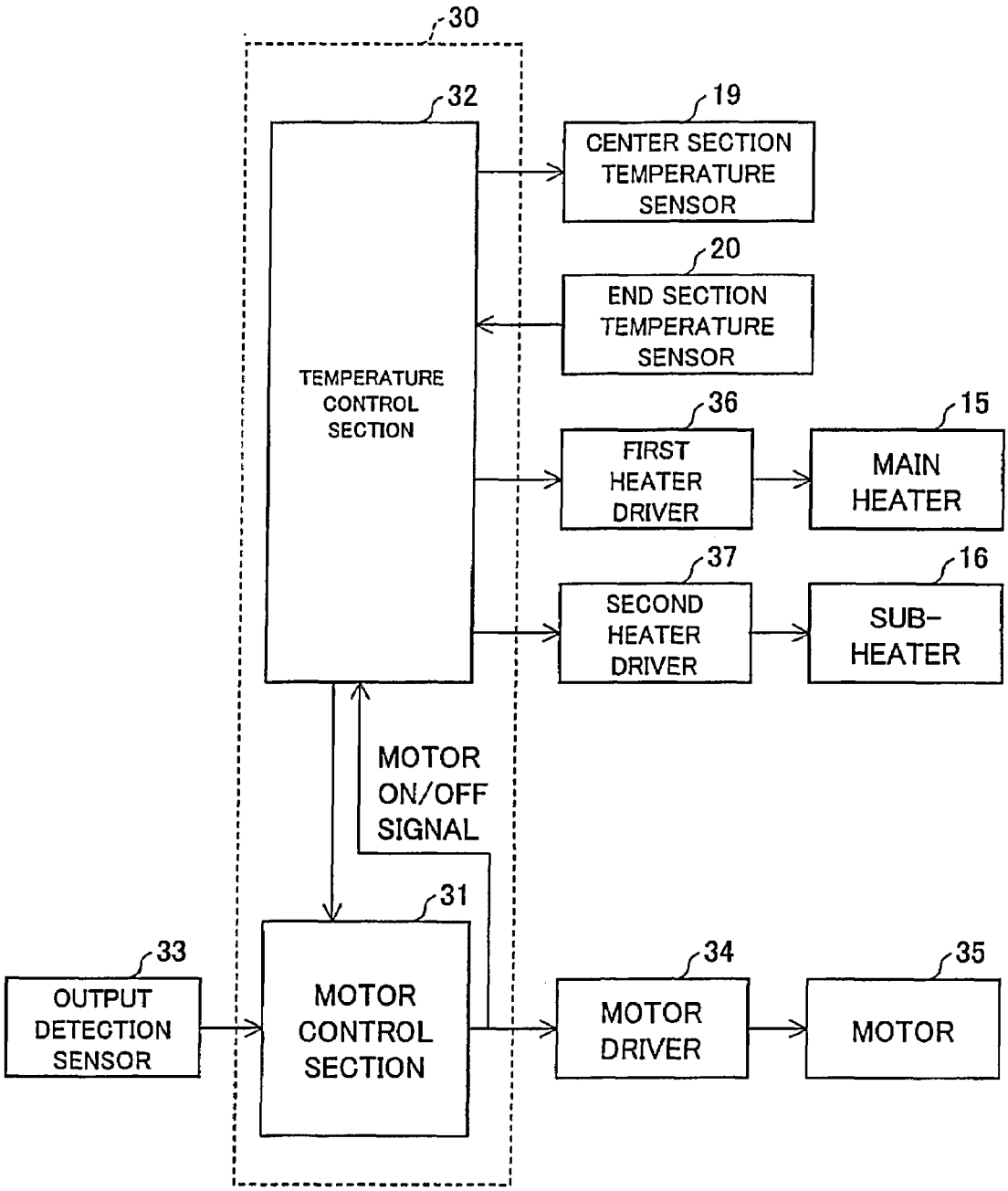
FIG. 1 is a block diagram illustrating an embodiment of the present invention and a configuration of a control system of a fixing unit.

The exposure unit 2 may be a laser scanning unit (LSU) including a laser irradiation section 2*a* and a reflecting mirror 2*b*, as illustrated in FIG. 1. The exposure unit 2 may also be a writing head in which an array of light emitting elements (for example, EL and LED) are arranged. The image forming apparatus 1 of the present embodiment realizes a high-speed printing by adopting a two beam technique which alleviates speeding up of irradiation timing by using a plurality of laser beams.

The developing unit 3 forms a toner image by developing with a black toner the latent image formed on the surface of the photoreceptor drum 10.

The transfer unit 11 transfers the toner image formed on the photoreceptor drum 10 by the developing unit 3 onto a sheet transported.

The fixing unit 6 fuses and fixes the toner image on the sheet on which the unfixed toner image has been transferred by the transfer unit 11, when the sheet passes through a space between a rotatable fixing roller (fixing member) 12 and a pressure roller (pressure member) 13 (hereinafter, referred to as a "fixing nip area"). The pressure roller 13 press-contacts the fixing roller 12. The fixing unit 6 is explained in details later.

The cleaning unit 5 removes and collects a residual toner left on the photoreceptor drum 10 after the image is developed and transferred.

The paper feed tray 8 is a tray storing paper sheets to be used for image formation. In the present embodiment, a plurality of paper feed trays 8 are disposed at a bottom part of the image forming apparatus 1 in order to carry out high-speed printing processing with respect to a large amount of paper sheets. In each of the paper feed trays, 500 to 1500 regular sized sheets of paper are stored. Moreover, in addition to the paper feed trays 8, a large capacity paper feed cassette (LCC) 81 and a manual paper feed tray 82 are disposed on the side surface of the image forming apparatus 1. The LCC 81 is capable of storing a large amount of paper sheets of different kinds. The manual paper feed tray 82 is used mainly when printing is carried out with respect to irregular sized paper sheets.

The output paper tray 9 holds a paper sheet on which image formation has been completed. The output paper tray 9 is disposed at a side surface of the image forming apparatus 1 opposite to the side surface thereof having the manual paper feed tray 82. Moreover, in the image forming apparatus 1 of the present embodiment, the output paper tray 9 can be optionally replaced by (i) a post processing device for carrying out, for example, stapling and/or hole-punching with respect to a paper sheet which has been subjected to image formation, and/or (ii) a plurality of output paper trays.

The control section 50 controls operations of the above mentioned members and carries out image processing based on image data. The control section 50 is a microcomputer including a CPU (Central Processing Unit) and a RAM (Random Access Memory) at least. The control section 50 operates by loading a program recorded in a storage medium (not shown). Detailed explanation is given later on the control section 50. The control section 50 constitutes a fixing control section (control means) 30 explained later.

Figure 3:
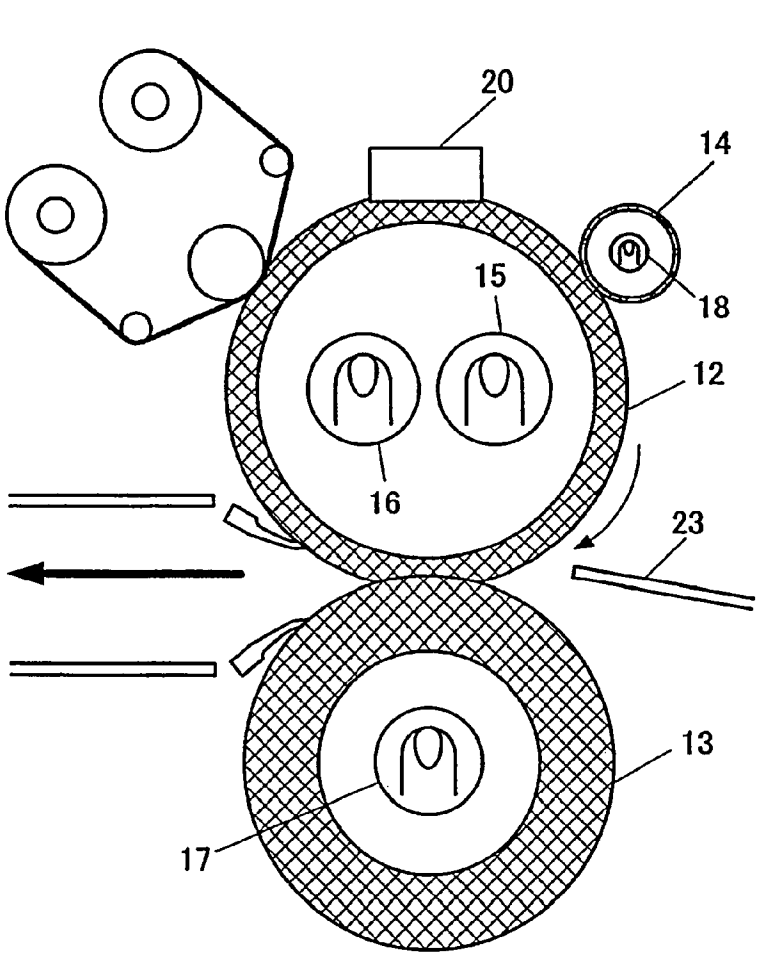
FIG. 3(*a*) is a sectional view illustrating a center section of the fixing unit, and FIG. 3(*b*) is a sectional view of an end section of the fixing unit.
Figure 3:
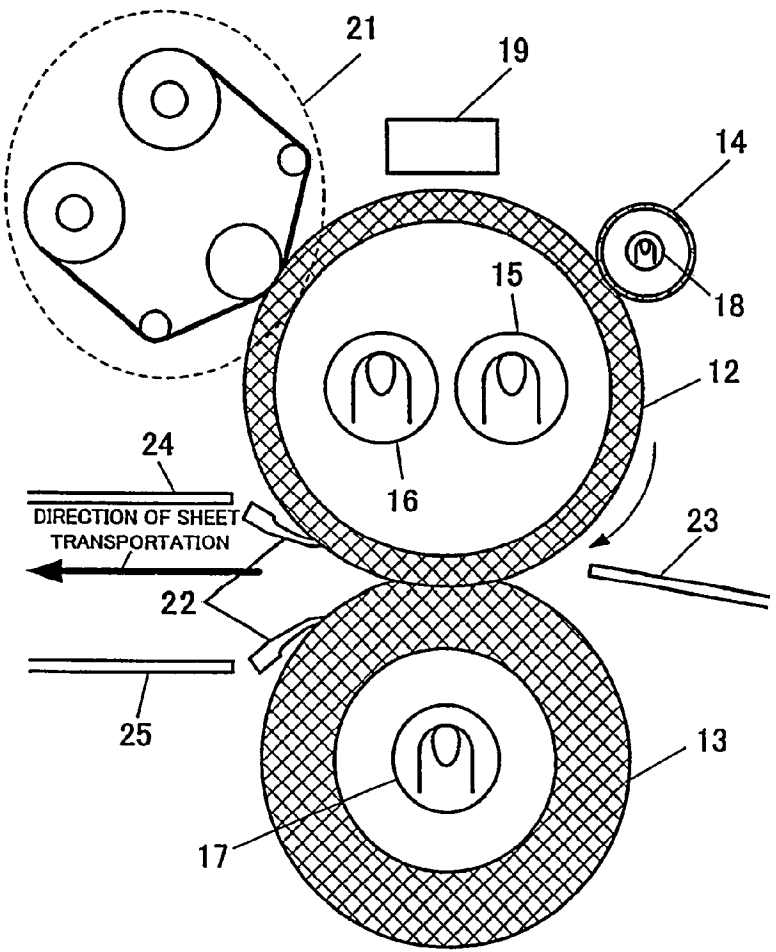

Next, the fixing unit 6 is explained in details. FIGS. 3(*a*) and 3(*b*) illustrate schematic cross sectional views of the fixing unit 6. FIG. 3(*a*) is a cross sectional view illustrating center sections of the fixing roller 12 and the pressure roller 13. FIG. 3(*b*) is a cross sectional view illustrating end sections of the fixing roller 12 and the pressure roller 13. Moreover, FIG. 4 illustrates a positional relationship between heat generating regions that give off heat in heat sources which are disposed inside the fixing roller 12, the pressure roller 13, and the like.

The fixing roller 12 is heated to a predetermined temperature and heats a paper sheet passing through the fixing nip area and having a toner image (unfixed) formed thereon. The fixing roller 12 is constituted by (i) a tube made of metal such as iron, stainless steel, aluminum, and copper, or metal alloy of combinations of any of these substances; and (ii) a silicone rubber (2 to 3 mm), as an elastic layer, wrapped around the tube. The layer made of silicone rubber has a function to provide a thermal storage effect. Moreover, a release layer (not shown) may be provided on the elastic layer. The release layer is made of fluorocarbon resin such as PFA (tetrafluoroetylene-perfluoroalkylvinylether copolymer) and PTFE (polytetrafluoroetylene).

The fixing roller 12 includes a heating section (heat source) inside the tube. The heating section raises a temperature of the surface of the fixing roller 12 to a temperature necessary for fixing a toner image. The surface of the fixing roller 12 is heated by the heat sources so as to have a preset fixing temperature (here, 180° C., but generally 160° C. to 200° C.). The heating section here includes two heat sources, a main heater (center section heat source, main heat source) 15 and a sub-heater (end section heat source, sub-heat source) 16. The heating section is arranged so as to be capable of heating the surface of the fixing roller 12 in such a manner that the center section and the end sections are heated separately.

Figure 4:
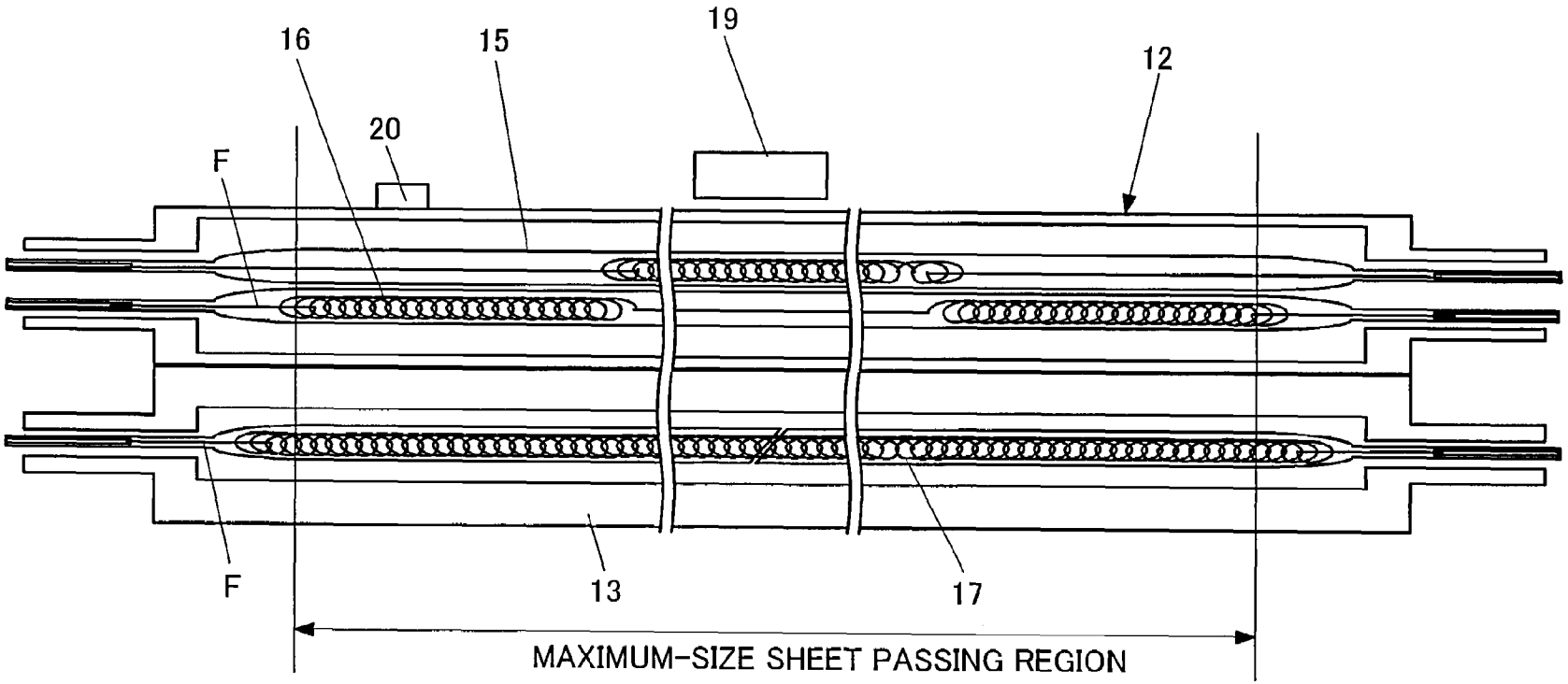
FIG. 4 is a view illustrating a positional relationship between heat generating regions that give off heat in heat sources which are disposed inside a fixing roller and a pressure roller both of which are included in the fixing unit.

As illustrated in FIG. 4, the main heater 15 has a heat generating region where a filament F is wound, at a position corresponding to the center section of the fixing roller 12. The heat generating region is arranged to heat the center section of the fixing roller 12. Meanwhile, the sub-heater 16 has heat generating regions where a filament F is wound at positions corresponding to opposite sides of the heat generating region of the main heater 15. The heat generating regions of the sub heater 16 are arranged to heat the end sections of the fixing roller 12.

In the center section and the end sections of the fixing roller 12 disposed are temperature sensors 19 and 20 for detecting surface temperatures of the fixing roller 12. The temperature sensors 19 and 20 are thermistors. These temperature sensors 19 and 20 constitute a temperature detecting section which detects the surface temperatures of areas on the fixing roller 12 corresponding to heating regions of the main heater 15 and the sub-heater 16, which are a heating section capable of heating the surface of the fixing roller 12 partially.

The temperature sensor 19 is a center section temperature sensor which is disposed so as not to be in contact with the surface of the fixing roller 12 (hereinafter referred to as center section temperature sensor 19). The center section temperature sensor 19 detects a temperature of the center section of the fixing roller 12. The temperature sensor 20 is an end section temperature sensor which is disposed so as to be in contact with the surface of the fixing roller 12 (hereinafter referred to as end section temperature sensor 20). The end section temperature sensor 20 detects a temperature of the end section of the fixing roller 12. The center section temperature sensor 19 is disposed so as not to be in contact with the fixing roller 12 because the center section has a high possibility of being damaged from a paper sheet wrapped around the surface of the fixing roller 12. This is because a paper sheet passes through the center section more frequently compared with the end sections. The center section temperature sensor 19 is at a location some distance from the surface of the fixing roller 12, and a temperature detected by the center section temperature sensor 19 is shifted from the surface temperature of the fixing roller 12 correspondingly. The shift in the temperatures is corrected by a temperature control section 32 later explained.

On the other hand, the pressure roller 13 includes a press-contacting mechanism (not shown) at end sections thereof. The press-contacting mechanism allows the pressure roller 13 to press-contact the fixing roller 12 at a predetermined pressure. The pressure roller 13 is constituted by (i) a tube made of metal such as, iron, stainless steel, aluminum, and copper, or metal alloy of combinations of any of these substances; and (ii) a silicone rubber (5 to 10 mm), as an elastic layer, wrapped around the tube. As with the layer on the fixing roller 12, the layer made of silicone rubber has a function to provide a thermal storage effect.

In the present embodiment, the pressure roller 13 is also provided therein with a heater (hereinafter, referred to as a pressure side heater) 17 that serves both as a heating section and a heat source. This arrangement suppresses an amount of heat that the pressure roller 13 takes away from the fixing roller 12. A heat generating region of the pressure side heater 17 covers an entire area of the pressure roller 13.

On respective peripheries of the fixing roller 12 and the pressure roller 13 disposed are paper separation claws 22. The paper separation claws 22 separate a paper sheet wrapped around the periphery of the fixing roller 12 or the pressure roller 13. Moreover, the cleaning unit 21 is provided on the periphery of the fixing roller 12. The cleaning unit 21 removes toner adhering to the surface of the fixing roller 12.

After a paper sheet guided along a paper guide 23 from the transfer unit 11 (Refer to FIG. 2) passes through the fixing nip area, the paper sheet is separated from the fixing roller 12 or the pressure roller 13 by the paper separation claws 22. Then, the paper sheet is carried along paper guides 24 and 25. After the paper sheet is separated, the surface of the fixing roller 12 is cleaned by the cleaning unit 21.

Moreover, the image forming apparatus 1 of the present embodiment is further provided with an external heating roller 14 in order to carry out high-speed printing processing. The external heating roller 14 heats the fixing roller 12 from the surface of the fixing roller 12. The external heating roller 14 has an arrangement in which a heater (hereinafter, referred to as an external heating heater) 18 is disposed inside a very thin tube made of aluminum, iron, or the like. The external heating heater 18 is a heating section and also a heat source. The tube of the external heating roller 14 has a thickness of 0.2 to 0.5 mm, which depends on which material is selected for the external heating roller 14. With this arrangement, a temperature of the external heating roller 14 quickly rises under heat from the external heating heater 18 so that the external heating roller 14 heats the surface of the fixing roller 12. As illustrated in FIG. 4, the external heating heater 18 provided inside the external heating roller 14 has a heat generating region that covers an entire area of the external heating roller 14.

In the fixing unit 6, among the fixing roller 12, the pressure roller 13, and the external heating roller 14, only the fixing roller 12 is connected to a driving source and driven so as to rotate. The surfaces of the pressure roller 13 and the external heating roller 14 are in contact with the surface of the fixing roller 12, which allows the pressure roller 13 and the external heating roller 14 to rotate dependently with respect to the rotation of the fixing roller 12.

FIG. 1 is a block diagram illustrating a control system of the fixing unit 6. In FIG. 1, a reference number 30 represents a fixing control section. The fixing control section 30 controls rotation of the fixing roller 12 and power supply to the heaters 15 through 18, in accordance with a temperatures detected by the center section temperature sensor 19 and the end section temperature sensor 20, which constitute the temperature detecting section. In this way, the fixing control section 30 controls the surface temperature of the fixing roller 12 so that the surface temperature of the fixing roller 12 becomes a preset fixing temperature.

The fixing control section 30 includes a motor control section 31 and a temperature control section 32. The motor control section 31 controls a motor 35 via a motor driver 34 in accordance with temperature data sent from the temperature control section 32 and an output of an output detection sensor 33. The motor 35 is a driving source for rotating the fixing roller. The output detection sensor 33 detects output of a paper sheet to the outside of a main body of the image forming apparatus 1.

The temperature control section 32 controls respective outputs (respective heat amounts) of the main heater 15, the sub-heater 16, the pressure side heater 17, and the external heating heater 18 via respectively corresponding heater drivers, in accordance with temperatures detected by the center section temperature sensor 19 and the end section temperature sensor 20. In this way, the temperature control section 32 controls the surface temperature of the fixing roller 12 so that the surface temperature of the fixing roller 12 is kept at a preset fixing temperature.

In the present embodiment, the respective outputs (respective heat amounts) of the heaters 15 through 18 are controlled by, for example, control of power supply to the heaters 15 through 18 at the respectively corresponding heater drivers. Specifically, the power supply (electrical connection) to the heaters 15 through 18 is on/off controlled. FIG. 1 illustrates only the main heater 15 and the sub-heater 16 and respectively corresponding first and second heater drivers 36 and 37. However, FIG. 1 omits the description concerning the pressure side heater 17 and the external heating heater 18, and the corresponding heater drivers.

The temperature control section 32 is arranged so as to receive an on/off signal indicative of whether the motor 35 is turned on or off from the motor control section 31. The on/off signal allows the temperature control section 32 to detect whether the fixing roller 12 is rotating or at a halt.

The fixing control section 30 includes temperature control modes for controlling the surface temperature of the fixing roller 12 so that the surface temperature becomes a preset fixing temperature by controlling the rotation of the fixing roller 12 and the power supply to the heaters 15 through 18, in accordance with the temperatures detected by the center section temperature sensor 19 and the end section temperature sensor 20. One of the temperature control modes that the fixing control section 30 includes is an end section priority temperature control mode.

In a general temperature control mode, the main heater 15 is on/off controlled, in accordance with a temperature detected by the center section temperature sensor 19 that detects the surface temperature of the area corresponding to the heating region of the main heater 15 on the fixing roller 12. Similarly, the sub-heater 16 is on/off controlled in accordance with a temperature detected by the end section temperature sensor 20 that detects the surface temperature of the area corresponding to the heating region of the sub-heater 16 on the fixing roller 12. Namely, the main heater 15 and the sub-heater 16 are independently on/off controlled in accordance with the temperatures detected by the center section temperature sensor 19 and the end section temperature sensor 20 respectively corresponding to the main heater 15 and the sub-heater 16.

On the contrary, in the end section priority temperature control mode, although the sub-heater 16 is on/off controlled as in the general temperature control mode, the main heater 15 is on/off controlled in accordance with a temperature detected by the end section temperature sensor 20 as well as a temperature detected by the center section temperature sensor 19. Furthermore, the aforesaid control puts priority on the temperature detected by the end section temperature sensor 20.

Specifically, in the end section priority temperature control mode, the fixing control section 30 temporarily turns off the main heater 15, judging that the surface temperature detected by the end section temperature sensor 20 has reached a preset upper-limit fixing temperature. In such a case, the main heater 15 is turned off even if the surface temperature detected by the center section temperature sensor 19 (surface temperature corrected according the distance apart from the surface) has not reached the preset fixing temperature. In an arrangement in which an amount of heat generated by the main heater 15 is controlled by changing an amount of power supply to the main heater 15, the amount of power supply to the main heater 15 is controlled so that the amount of heat generated by the main heater 15 decreases.

Here, when the fixing control section 30 determines that the surface temperature detected by the end section temperature sensor 20 has decreased to a preset allowable temperature between the upper-limit fixing temperature and the preset fixing temperature after turning off the main heater 15, the fixing control section 30 turns on the main heater 15 again to restart or restore the power supply to the main heater 15.

The upper-limit fixing temperature and the allowable temperature mentioned above are set in consideration of, for example, (i) the destructive temperature of the fixing roller 12, (ii) a difference in temperature between the center section of the fixing roller 12 and the end section of the fixing roller 12 in a case where a small-sized paper sheet is printed, and (iii) heat conductivity of the fixing roller 12. The upper-limit fixing temperature and the allowable temperature are set so that (i) the main heater 15 is not needlessly turned off temporarily and (ii) the temperature at the center section of the fixing roller 12 does not become lower than a lower-limit fixing temperature that is a lower limit that guarantees fixing performance, due to long turn-off of the main heater 15.

In such an end section priority temperature control mode, the fixing roller 12 is driven to rotate. Accordingly, the rollers 12, 13, and 14 are kept rotating in the fixing unit 6.

The fixing control section 30 carries out the end section priority temperature control mode during printing and during a temperature restoration process of the above-mentioned fixing roller 12 right after the end of printing.

Figure 5:
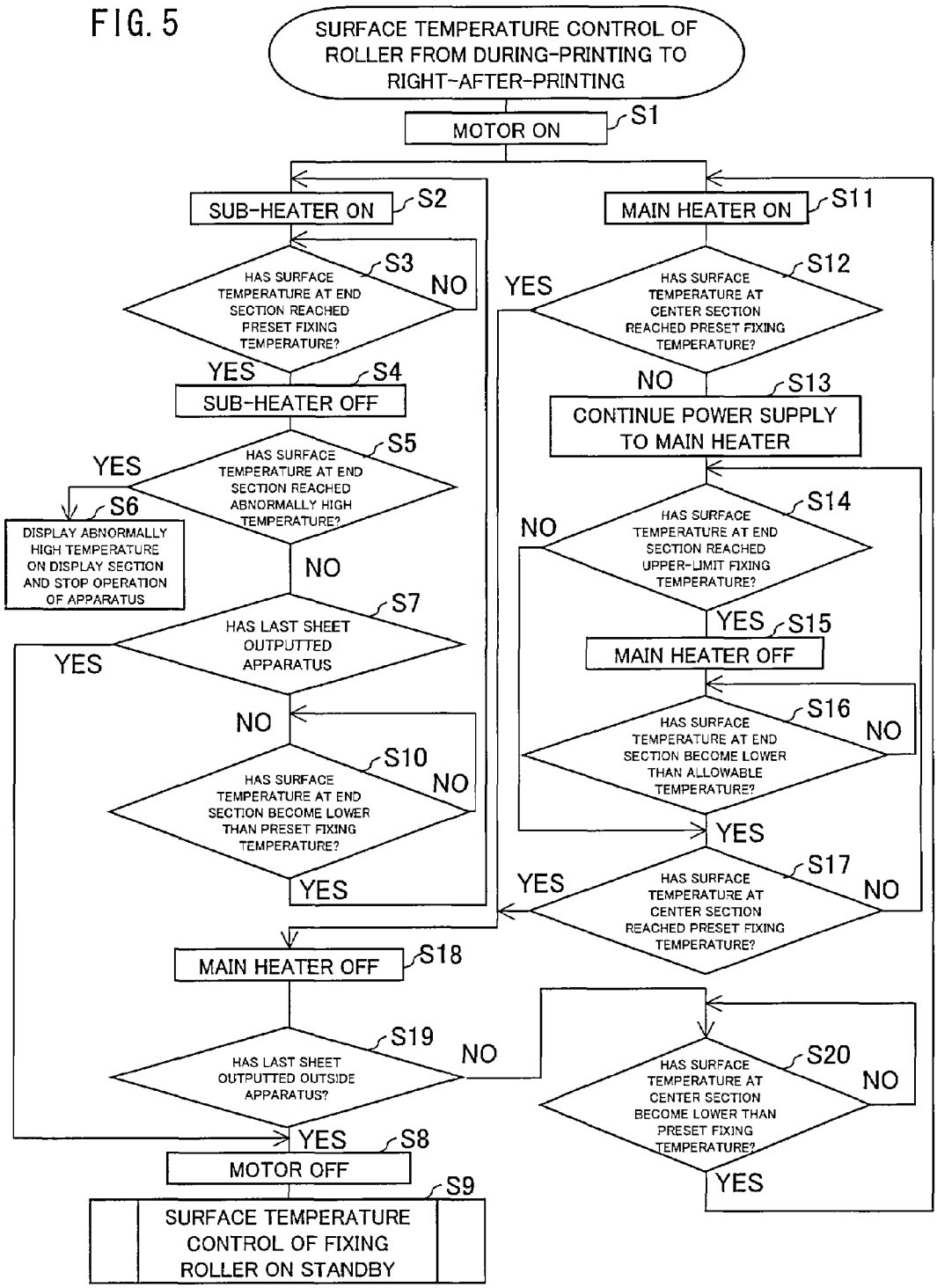
FIG. 5 is a flow chart illustrating an example of a flow of a surface temperature control of the fixing roller during printing and right after end of printing before the surface temperature control for the fixing roller on standby is actually subjected to the fixing roller.

FIG. 5 illustrates an example of a flow of a surface temperature control of the fixing roller 12 during printing and right after end of printing before the surface temperature control for the fixing roller 12 on standby is actually subjected to the fixing roller 12.

First, the motor 35 is turned on (S1), and the main heater 15 and the sub-heater 16 are turned on (S2, S11). This rotates the fixing roller 12. Accordingly, the pressure roller 13 and the external heating roller 14 are driven to rotate. At the same time, the fixing roller 12 starts to be heated. Although the heaters 17 and 18 of the pressure roller 13 and the external heating roller 14 are accordingly turned on, this is not directly involved in the end section priority temperature control mode. Therefore, description in FIG. 5 and explanation thereof are omitted.

Then, the main heater 15 and the sub-heater 16 are individually on/off controlled and the end section priority temperature control mode is carried out.

As to the sub-heater 16, when the sub-heater 16 is turned on at S2, the fixing control section 30 judges whether the surface temperature of the end section of the fixing roller 12 has reached the preset fixing temperature, for example, 180° C., on the basis of a temperature detected by the end section temperature sensor 20 (S3). Such a judgement is repeated until the surface temperature of the end section of the fixing roller 12 reaches the preset fixing temperature. Judging that the surface temperature of the end section has reached the preset fixing temperature, the fixing control section 30 turns off the sub-heater 16 (S4).

After turning off the sub-heater 16, the fixing control section 30 judges whether the surface temperature of the end section of the fixing roller 12 has reached an abnormally high temperature, for example, 240° C. (S5). At S5, in a case where the surface temperature of the end section has reached the abnormally high temperature, the fixing control section 30 displays the result of the judgement on a display section and stops an operation of the image forming apparatus 1 (S6). On the contrary, in a case where the surface temperature of the end section has not reached the abnormally high temperature, the fixing control section 30 judges whether a last paper sheet has been outputted outside the image forming apparatus 1 (S7).

At S7, if the last paper sheet has been outputted outside, the fixing control section 30 judges that a printing job has finished and turns off the motor 35 (S8). Moreover, the fixing control section 30 proceeds to the surface temperature control mode of the fixing roller 12 on standby (S9). On the contrary, in a case where that last paper sheet has not been outputted, the fixing control section 30 judges whether the surface temperature of the end section of the fixing roller 12 has become lower than the preset fixing temperature (here 180° C.) (S11). Such a judgement is repeated until the fixing control section 30 judges that the surface temperature of the end section of the fixing roller 12 has become lower than the preset fixing temperature. Judging that the surface temperature of the end section has become lower than the preset fixing temperature, the fixing control section returns to S2 and turns on the sub-heater 16.

Next, as to the main heater 15, after turning on the main heater 15 at S11, the fixing control section 30 judges whether a surface temperature of the center section of the fixing roller 12 has reached the preset fixing temperature (here 180° C.) (S12). In a case where a surface temperature of the center section of the fixing roller 12 has reached the preset fixing temperature, the control section 30 proceeds to S18 later explained and turns off the main heater 15.

On the contrary, in a case where the surface temperature of the center section of the fixing roller 12 has not reached the preset fixing temperature, the fixing control section 30 keeps turning on the main heater 15 (S13). Subsequently, the fixing control section 30 judges whether the surface temperature of the end section of the fixing roller 12 has reached the upper-limit fixing temperature, for example, 230° C. (S14). In a case where the upper-limit fixing temperature has not been reached, the fixing control section 30 again judges whether the surface temperature of the center section of the fixing roller 12 has reached the preset fixing temperature (here 180° C.) (S17).

On the contrary, in a case where the surface temperature of the end section of the fixing roller 12 has reached the upper-limit fixing temperature at S14, the fixing control section 30 turns off the main heater 15 (S15). Then, the fixing control section 30 judges whether the surface temperature of the end section of the fixing roller 12 has become lower than the allowable temperature, for example, 200° C. Such a judgement is repeated until the surface temperature of the end section of the fixing roller 12 becomes lower than the allowable temperature (S16). Obtaining the judgement that the surface temperature of the end section of the fixing roller 12 has become lower than the allowable temperature, the fixing control section 30 proceeds to S17 and judges whether the surface temperature of the center section of the fixing roller 12 has reached the preset fixing temperature (here 180° C.).

In a case where the preset fixing temperature has not been reached at S17, the fixing control section 30 returns to S11 and turns on the main heater 15. On the contrary, in a case where the preset fixing temperature has reached at S17, the fixing control section 30 proceeds to S18 and turns off the main heater 15.

After turning off the main heater 15 at S18, the fixing control section 30 judges whether a last paper sheet has been outputted outside the image forming apparatus 1 (S19). In a case where the last paper sheet has been outputted outside, the fixing control section 30 judges that a printing job has finished, and turns off the motor 35 (S8). On the contrary, in a case where that last paper sheet has not been outputted, the fixing control section 30 judges whether the surface temperature of the center section of the fixing roller 12 has become lower than the preset fixing temperature (here 180° C.) (S20). Such a judgement is repeated until the fixing control section 30 judges that the surface temperature of the center section of the fixing roller 12 has become lower than the preset fixing temperature. Judging that the surface temperature of the center section of the fixing roller 12 has become lower than the preset fixing temperature, the fixing control section 30 returns to S11 and turns on the main heater 15.

Figure 6:
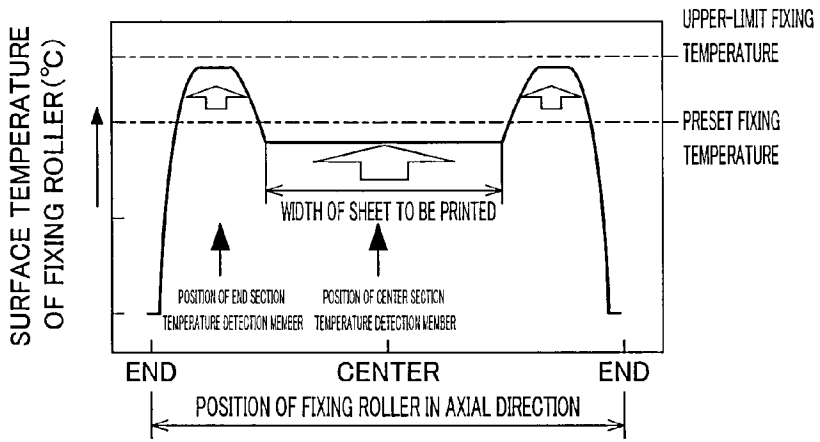
FIGS. 6(*a*) through 6(*d*) each illustrates a relationship between (i) a position of the fixing roller in its axial direction and (ii) a surface temperature of the fixing roller in an image forming apparatus of the present invention, during or right after continuous printing using small-sized paper sheets.
Figure 6:
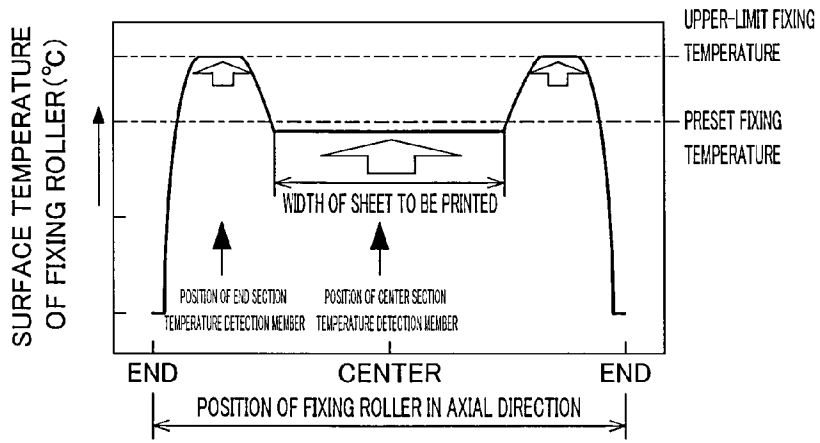
Figure 6:
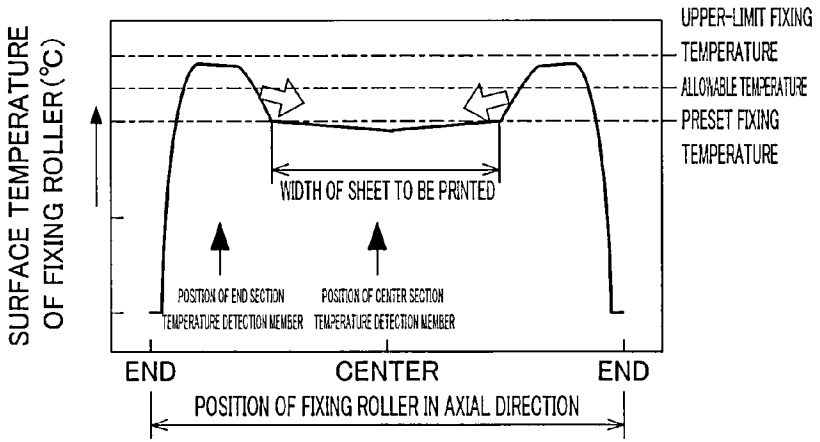
Figure 6:
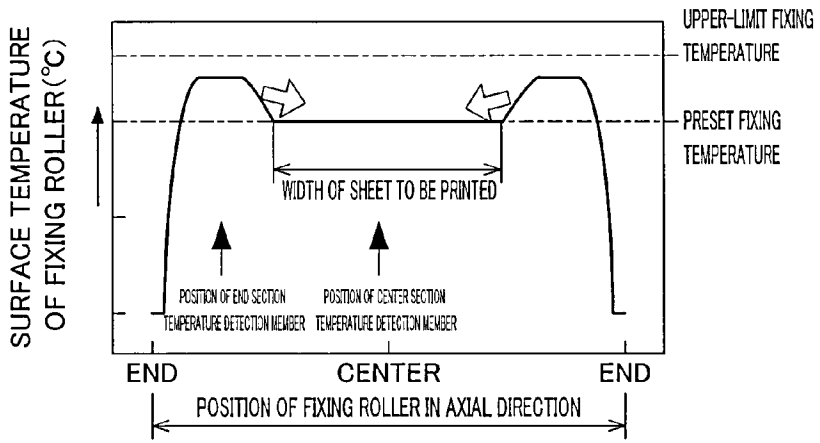
Figure 7:
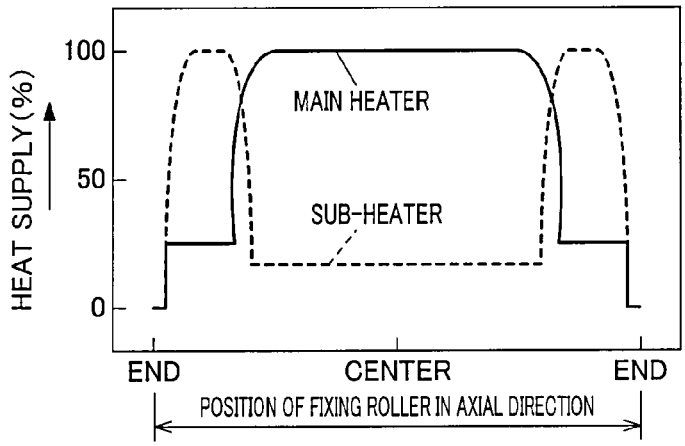
FIG. 7 is a diagram illustrating a relationship between the position of the fixing roller in its axial direction and a heat supply rate of each of a main heater and a sub-heater.
Figure 8:
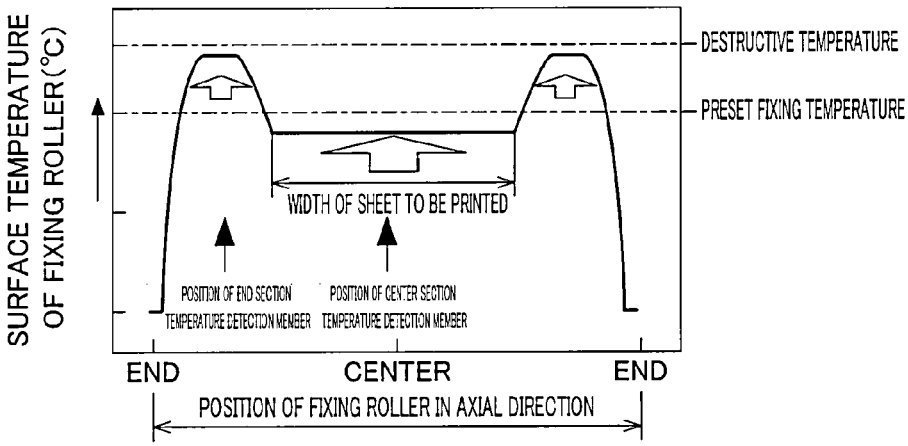
FIGS. 8(*a*) and 8(*b*) each is a diagram illustrating a relationship between the position of the fixing roller in its axial direction and a surface temperature of the fixing roller in a conventional image forming apparatus, during or right after continuous printing using small-sized paper sheets.
Figure 8:
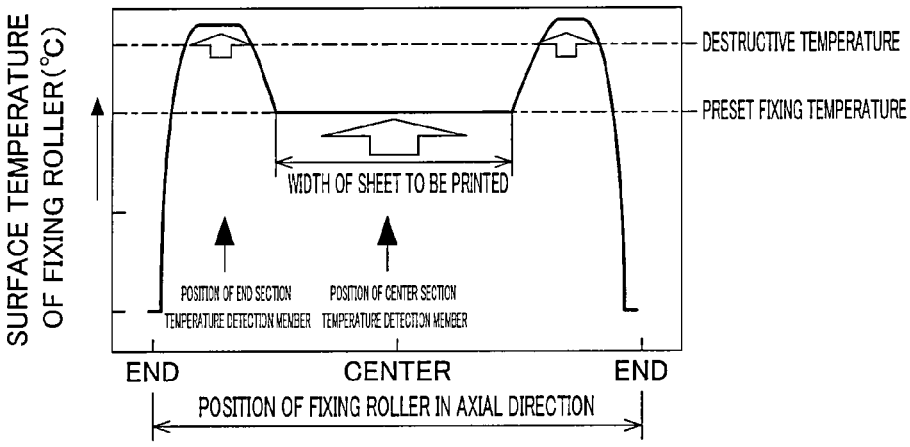

FIGS. 6(*a*) through 6(*d*) each illustrates a relationship between a position of the fixing roller 12 in its axial direction and a surface temperature of the fixing roller 12 right after or during the continuous printing using small-sized paper sheets.

As illustrated in FIG. 6(*a*), the surface temperature of the center section of the fixing roller 12 becomes lower than the preset fixing temperature when a small-sized paper sheet is printed, because heat is taken away from the fixing roller 12 by the paper sheet passing between the fixing roller 12 and the pressure roller 13. Consequently, the main heater 15 is turned on.

The main heater 15 heats the center section of the fixing roller 12, and a temperature of the center section of the fixing roller 12 rises. At this time, due to unnecessary heat supply from the main heater 15, the end sections of the fixing roller 12 are also heated, and temperatures of the end sections of the fixing roller 12 gradually rise. As a result, as illustrated in FIG. 6(*b*), the temperatures of the end sections of the fixing roller 12 reach the upper-limit fixing temperature.

When the temperatures of the end sections of the fixing roller 12 reach the upper-limit fixing temperature, the main heater 15 is temporarily turned off. Even if the main heater 15 is turned off, as illustrated in FIG. 6(*c*), heat is transmitted to the center section from the end sections due to heat conduction in the fixing roller 12. As a result, the temperature of the center section rises and the temperatures of the end sections decrease.

Due to such heat transmission in the fixing roller 12 and heat dissipation into the air, the temperatures of the end sections of the fixing roller 12 decrease to the allowable temperature. Then, the main heater 15 is turned on again, and the center section of the fixing roller 12 starts to be heated again.

The main heater 15 is repeatedly turned on and off in consideration of the temperatures of the end sections in this way. As a result, as illustrated in FIG. 6(*d*), the temperatures of the end sections of the fixing roller 12 do not exceed the upper-limit fixing temperature, and the temperature of the center section of the fixing roller 12 reaches the preset fixing temperature.

Because continuous printing using small-sized paper sheets keeps the main heater 15 on and unnecessary heat is continuously supplied to the end sections of the fixing roller 12, the surface temperatures of the end sections of the fixing roller 12 gradually rise. However, as mentioned above, in the fixing unit 6 of the image forming apparatus 1, the main heater 15 is turned off temporarily when the surface temperature of the end section of the fixing roller 12 exceeds the upper-limit fixing temperature. Accordingly, the surface temperature of the end section of the fixing roller 12 does not exceed the destructive temperature of the fixing roller 12. Therefore, the surface layer of the fixing roller 12 is not destroyed.

The surface temperatures of the end sections of the fixing roller 12 never or hardly reach an abnormally high temperature (here, 240° C.) due to unnecessary heat supply from the main heater 15 except when abnormal circumstances such as a machine trouble happen, the abnormally high temperature being set at a temperature a little lower than the destructive temperature in order to prevent the destruction of the surface layer. Accordingly, an operation rate of the image forming apparatus 1 does not decrease.

Moreover, the fixing control section 30 judges that the surface temperature detected by the end section temperature sensor 20 has decreased to a preset allowable temperature between the upper-limit fixing temperature and the preset fixing temperature, after turning off the main heater 15 in this way. Judging that the surface temperature has decreased to the preset allowable temperature, the fixing control section 30 turns on the main heater 15 again and restarts or restores the power supply to the main heater 15.

In this way, the timing for turning on the main heater 15 after the main heater 15 is temporarily turned off is defined by the temperature of the end section of the fixing roller 12. This allows the timing to directly correspond to the temperature of the end section of the fixing roller 12, compared with an arrangement in which the timing is defined by a time between turn-off and turn-on of the main heater 15. As a result, a time for the entire fixing roller 12 to reach the preset fixing temperature is reduced to a minimum.

There are two regions capable of heating separately in the above-explained example of a heating section inside the fixing roller 12, which includes the main heater 15 and the sub-heater 16. However, the heating section can certainly adopt a heating section including more than two regions. Namely, when more than two heaters are disposed inside the fixing roller, a heater at the center, which unnecessarily heats the end sections and frequently needs to heat, should be on/off controlled in accordance with a surface temperature of an area corresponding to a heating region of a heater which is disposed closer to an end section compared with the heater at the center section.

As mentioned above, a fixing apparatus of the present invention is a fixing apparatus which causes a recording material to pass through a space between a rotatable fixing member and a pressure member that press-contacts the fixing member, so as to fix a toner image formed on the recording material, the fixing apparatus comprising: a heating section, provided inside the fixing member, which includes a plurality of heat sources having mutually different heating regions; a temperature detecting section which detects surface temperatures of areas on the fixing member corresponding to the heating regions of the respective heat sources; and a fixing control section which controls (i) rotation of the fixing member and (ii) power supply to each of the heat sources so that the surface temperatures of the fixing member become a preset fixing temperature, in accordance with temperatures detected by the temperature detecting section, wherein: the fixing control section (i) controls power supply to a center section heat source which heats as the heating region a center section of the fixing member, in accordance with (a) a detected surface temperature of an area on the fixing member corresponding to the heating region of the center section heat source and (b) a detected surface temperature of an area on the fixing member corresponding to the heating region of an end section heat source which heats end sections of the fixing member, the heating region of the end section heat source being provided on an end section side of the fixing member with respect to the center section heat source, and (ii) includes an end section priority temperature control mode in which a high priority in the control of power supply to the center section heat source is put on the detected surface temperature of the area corresponding to the heating region of the end section heat source.

As mentioned above, an image forming apparatus of the present invention is an image forming apparatus including a fixing apparatus which causes a recording material to pass through a space between a rotatable fixing member and a pressure member that press-contacts the fixing member, so as to fix a toner image formed on the recording material, the image forming apparatus comprising: a plurality of heat sources, disposed inside the fixing member, having mutually different heating regions; a temperature detecting section which detects surface temperatures of areas of the fixing member corresponding to the heating regions of the respective heat sources; and a fixing control section which controls (i) rotation of the fixing member and (ii) power supply to each of the heat sources so that the surface temperatures of the fixing member become a preset fixing temperature, in accordance with temperatures detected by the temperature detecting section, wherein: the fixing control section (i) controls power supply to a center section heat source which heats as the heating region a center section of the fixing member, in accordance with (a) a detected surface temperature of an area on the fixing member corresponding to the heating region of the center section heat source and (b) a detected surface temperature of an area on the fixing member corresponding to the heating region of an end section heat source which heats end sections of the fixing member, the heating region of the end section heat source being provided on an end section side of the fixing member with respect to the center section heat source, and (ii) includes an end section priority temperature control mode in which a high priority in the control of power supply to the center section heat source is put on the detected surface temperature of the area corresponding to the heating region of the end section heat source.

According to the above-mentioned arrangement, the fixing control section includes the end section priority temperature control mode. In the end section priority temperature control mode, the fixing control section (i) controls power supply to a center section heat source which heats as the heating region a center section of the fixing member, in accordance with (a) a detected surface temperature of an area on the fixing member corresponding to the heating region of the center section heat source and (b) a detected surface temperature of an area on the fixing member corresponding to the heating region of an end section heat source which heats end sections of the fixing member, the heating region of the end section heat source being provided on an end section side of the fixing member with respect to the center section heat source, and (ii) puts a high priority in the control of power supply to the center section heat source on the detected surface temperature of the area corresponding to the heating region of the end section heat source.

For example, as a result of continuous power supply to the center section heat source for continuous printing on small-sized paper sheets, the surface temperature of the end section of the fixing member gradually rises due to unnecessary heat supply to the end section of the fixing member from the center section heat source although the power supply to the end section heat source is stopped. In such a case, if the surface temperature of the end section of the fixing member reaches an abnormally high temperature, the fixing control section controls the power supply to the center section heat source.

Accordingly, it is possible to prevent the occurrence of an event where the surface layer of the fixing member is destroyed due to a rise in the temperature at the end section of the fixing member by the unnecessary heat supply.

The end section priority temperature control mode can be carried out (i) during printing or (ii) during a temperature restoration process of the fixing member right after end of printing.

The fixing apparatus of the present invention can be arranged such that the fixing control section temporarily stops or suppresses the power supply to the center section heat source in the end section priority temperature control mode when the fixing control section judges that the surface temperature of the area corresponding to the heating region of the end section heat source has reached a preset upper-limit fixing temperature, even when the surface temperature of the area corresponding to the heating region of the center section heat source is lower than the preset fixing temperature. Here, the upper-limit fixing temperature is higher than the preset fixing temperature and lower than a temperature at which the fixing member is destroyed.

According to this, the fixing control section temporarily stops or suppresses the power supply to the center section heat source when the fixing control section judges that the detected surface temperature of the area corresponding to the heating region of the end section heat source has reached a preset upper-limit fixing temperature, even when the detected surface temperature of the area corresponding to the heating region of the center section heat source is lower than the preset fixing temperature. Therefore, it is possible to reliably prevent, except when abnormal circumstances such as a machine trouble happen, an event such that the surface layer of the fixing member is destroyed by a rise in the end section temperature of the fixing member due to the unnecessary heat supply. Therefore, a decrease in operation rate can be effectively prevented.

Moreover, in this case, in the end section priority temperature control mode, the fixing control section may be arranged so as to restart or restore the power supply to the center section heat source, when the fixing control section judges that the surface temperature of the area corresponding to the heating region of the end section heat source has decreased to a preset allowable temperature which is in a range between the upper-limit fixing temperature and the preset fixing temperature.

In this way, the timing for restarting or restoring the power supply to the center section heat source is defined by a temperature at the end section of the fixing member. Consequently, the timing can correspond directly to the temperature at the end section of the fixing member, compared with an arrangement in which the timing is defined by time between stop/suppression of the heat supply and the restart/restoration of the heat supply. As a result, it becomes possible to shorten a time for the entire fixing member to reach the preset fixing temperature.

Furthermore, in the fixing apparatus of the present invention, the heating section may include two heat sources, (i) a main heat source which heats the center section of the fixing member as the heating region, and (ii) a sub-heat source which heats the end sections of the fixing member as the heating region.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A fixing apparatus which causes a recording material to pass through a space between a rotatable fixing member and a pressure member that press-contacts the fixing member, so as to fix a toner image formed on the recording material, the fixing apparatus comprising:

a heating section, provided inside the fixing member, which includes a plurality of heat sources having mutually different heating regions;

a temperature detecting section which detects surface temperatures of areas on the fixing member corresponding to the heating regions of the respective heat sources; and a fixing control section which controls (i) rotation of the fixing member and (ii) power supply to each of the heat sources so that the surface temperatures of the fixing member become a preset fixing temperature, in accordance with temperatures detected by the temperature detecting section, wherein:

the fixing control section (i) controls power supply to a center section heat source which heats as the heating region a center section of the fixing member, in accordance with (a) a detected surface temperature of an area on the fixing member corresponding to the heating region of the center section heat source and (b) a detected surface temperature of an area on the fixing member corresponding to the heating region of an end section heat source which heats as the heating region end sections of the fixing member, the heating region of the end section heat source being provided on an end section side of the fixing member with respect to the center section heat source, and (ii) includes an end section priority temperature control mode in which a high priority in the control of power supply to the center section heat source is put on the detected surface temperature of the area corresponding to the heating region of the end section heat source; and the fixing control section temporarily stops or suppresses the power supply to the center section heat source in the end section priority temperature control mode when the fixing control section judges that the surface temperature of the area corresponding to the heating region of the end section heat source has reached a preset upper-limit fixing temperature, even when the surface temperature of the area corresponding to the heating region of the center section heat source is lower than the preset fixing temperature.

2. The fixing apparatus as set forth in claim 1, wherein:

the upper-limit fixing temperature is set in a range between the preset fixing temperature and a destructive temperature at which the fixing member is destroyed.

3. The fixing apparatus as set forth in claim 1, wherein:

in the end section priority temperature control mode, the fixing control section restarts or restores the power supply to the center section heat source, when the fixing control section judges that the surface temperature of the area corresponding to the heating region of the end section heat source has decreased to a preset allowable temperature which is in a range between the upper-limit fixing temperature and the preset fixing temperature.

4. The fixing apparatus as set force in claim 1, wherein:

the heating section includes two heat sources, (i) a main heat source which heats the center section of the fixing member as the heating region, and (ii) a sub-heat source which heats the end sections of the fixing member as the heating region.

5. The fixing apparatus as set forth in claim 1, wherein:

the fixing control section carries out the end section priority temperature control mode (i) during printing or (ii) during a temperature restoration process of the fixing member right after end of printing.

6. An image forming apparatus including a fixing apparatus which causes a recording material to pass through a space between a rotatable fixing member and a pressure member that press-contacts the fixing member, so as to fix a toner image formed on the recording material, wherein:

the fixing apparatus includes:

a heating section, provided inside the fixing member, which includes a plurality of heat sources having mutually different heating regions;

a temperature detecting section which detects surface temperatures of areas on the fixing member corresponding to the heating regions of the respective heat sources; and a fixing control section which controls (i) rotation of the fixing member and (ii) power supply to each of the heat sources so that the surface temperatures of the fixing member become a preset fixing temperature, in accordance with temperatures detected by the temperature detecting section, wherein:

the fixing control section (i) controls power supply to a center section heat source which heats as the heating region a center section of the fixing member, in accordance with (a) a detected surface temperature of an area on the fixing member corresponding to the heating region of the center section heat source and (b) a detected surface temperature of an area on the fixing member corresponding to the heating region of an end section heat source which heats as the heating region end sections of the fixing member, the heating region of the end section heat source being provided on an end section side of the fixing member with respect to the center section heat source, and (ii) includes an end section priority temperature control mode in which a high priority in the control of power supply to the center section heat source is put on the detected surface temperature of the area corresponding to the heating region of the end section heat source; and the fixing control section temporarily stops or suppresses the power supply to the center section heat source in the end section priority temperature control mode when the fixing control section judges that the surface temperature of the area corresponding to the heating region of the end section heat source has reached a preset upper-limit fixing temperature, even when the surface temperature of the area corresponding to the heating region of the center section heat source is lower than the preset fixing temperature.

* * * * *